US005909834A

United States Patent [19]

Parrott, III

[11] Patent Number: 5,909,834

[45] Date of Patent: Jun. 8, 1999

[54] CONCEALED CARRY HOLSTER

[76] Inventor: Charles W. Parrott, III, 3315 S.W. 45th Ct., Ft. Lauderdale, Fla. 33312

[21] Appl. No.: 08/912,959

[22] Filed: Jul. 14, 1997

[51] Int. Cl.[6] ..... A45C 1/04

[52] U.S. Cl. ..... 224/587; 224/660; 224/664; 224/677

[58] Field of Search ..... 224/191, 192, 224/193, 243, 587, 660, 662, 664, 677, 901.2, 911, 912; D3/222

[56] References Cited

U.S. PATENT DOCUMENTS

| | | | |
|---|---|---|---|
| D. 361,656 | 8/1995 | Fogarty, Jr. | D3/222 |
| 3,797,715 | 3/1974 | Scialdone | 224/193 |
| 5,170,919 | 12/1992 | DeSantis et al. | 224/229 |
| 5,431,318 | 7/1995 | Garcia | 224/192 |

*Primary Examiner*—David J. Walczak
*Assistant Examiner*—Timothy L. Maust

[57] ABSTRACT

A handgun holster for concealment under a user's clothing includes a forward panel formed of multiple forward sheets placed face to face and having forward sheet upper edges cuffed toward each other and sewn together with a forward stitched cuff interconnection seam so that the forward sheet upper edges are contained between the forward sheets; a rearward panel formed of multiple rearward sheets placed face to face and having rearward sheet upper edges cuffed toward each other and sewn together with a rearward stitched cuff interconnection seam so that the rearward sheet upper edges are contained between the rearward sheets; so that a gun is not caught on the forward and rearward sheet upper edges; and a strap from the forward and rearward panels rearwardly and defining a loop for encircling and thereby engaging a user waist. The handgun holster preferably additionally includes a piece of batting extending into the forward cuff, the stitched cuff interconnection seam passing through the batting and thereby forming a french seam at the forward panel upper edge.

11 Claims, 3 Drawing Sheets

CONCEALED CARRY HOLSTER

BACKGROUND OF THE INVENTION

This invention relates to a concealed carry holster for handguns that is designed so that it will not snag on the rear of the cylinders of revolvers or protrusions on some semi-automatic pistols when the firearm is drawn by the user. It is also carried independent of the wearers clothing and is not restrictive of any body movements made by the user.

U.S. Pat. No. 5,575,028, November 1996 Brau, et al., does not relate to a handgun holster, but is a TOOTH FAIRY PILLOW made of fabric sewn together with pockets and openings and the construction is similar to my invention. U.S. Pat. No. D. 333,570, March 1993, Murray, does not describe a handgun holster, but has similarities to my invention in that it is constructed of fabric, has a supporting strap for around the waist use and contains two pouches for the transportation of beverages. U.S. Pat. No. 3,227,336, March 1964, Dickey, describes a handgun holster that is worn inside the lower outer garment but depends on the wearer's belt or waist band for support. This method of attachment, varying with the weight of the handgun carried, will pull down on the lower outer garment, which can be annoying to the wearer, and leaves a portion of the attaching S-shaped clip or hook exposed above the wearers belt, unless an outer garment (sweater or jacket) is worn. U.S. Pat. No. 3,227,337 January 1966, Santo, Jr., shows a variety of holsters worn by the user attached to a belt, worn outside the trousers. No provision is made for the concealment of these holsters, unless a long jacket is worn, or for the carrying of a tactical back-up reload. U.S. Pat. No. 4,258,871, March 1981, McMahon, No. shows a holster that may be worn inside the lower trousers leg as an ankle holster or under the armpit as a shoulder holster. Ankle holsters have been shown to be very awkward and difficult to retrieve a weapon from, and eliminate female law enforcement officers or licensed concealed carry users from using these when wearing skirts. Also, the wearing of shorts by either male or female users prohibits the use of ankle holsters. When used under the armpit as a shoulder holster, additional clothing, such as a jacket or sweater must be worn to conceal the weapon. U.S. Pat. No. 5,570,830, November 1996, Nichols, shows a holster employing a spine and seamless construction but is not readily adaptable for concealed carry use or carrying of a tactical back up reload. U.S. Patent No. D 361,656, August 1995, Fogarty, Jr., shows a handgun holster of similar design to my invention but does not have firearm pockets of the correct shape for fast access when drawing of the firearm and it also has a border of bias tape along the top front edge of the firearm pockets, which has been shown to snag on the rear of cylinders of revolvers or forward-facing protrusions on some semi-automatic firearms when drawing the firearm, thus impeding the speed of retrieving the weapon.

My invention allows law enforcement officers and licensed concealed carry permit holders to carry a concealed firearm with no restrictions on the type of clothing worn. It also provides maximum comfort, whereas it is completely independent of the clothing worn and allows a t-shirt or no shirt at all to be worn, which is very important in tropical and sub-tropical climates. Another very important advantage to my invention is that it permits any type of body movement that can be performed when not carrying a concealed firearm to be carried out when carrying a firearm in my invention.

BRIEF SUMMARY OF THE INVENTION

This invention is directed at providing law-enforcement personnel and licensed holders of concealed carry permits with an extremely comfortable method that is independent of the clothing worn by the user. It also provides complete freedom of the body movements of the wearer. When wearing my invention and carrying a handgun, even those as large and heavy as the U.S. Military Model 1911 A-1, the user can still run, jump, climb and preform any strenuous activity that can be done when not carrying a concealed firearm. This comfort is obtained by the fact that the strong bones of the hips transport the weight of the firearm, not the soft tissue of the waist. As my invention, the Thunder belt™ concealed carry holster, locates the firearm in a forward central location on the body's centerline, it does not offset the body's natural balance. When the user bends over, such as must be done prior to seating one's self, the barrel or slide of the firearm tucks itself between the user's legs, and sensitive body parts are behind and protected by the firearm.

In addition to providing the deepest concealment possible, my invention offers an extremely fast draw when the firearm is required.

The outer garment, whether it is trousers, shorts, slacks, skirt or a dress, keeps the holster comfortably snug against the shirt, undershirt, or slip and the users body. It is possible to stand on one's head, completely vertical, and shake one's hips. The firearm will not exit the holster, as the outer garment holds the firearm firmly in place.

BRIEF DESCRIPTION OF THE SEVERAL VIEWS OF THE DRAWING

Drawing sheets 1/3 and 3/3 are drawn to a scale of ¼ inch equals 1 inch and drawing sheet 2/3 is drawn to a scale of ⅛ inch equals 1 inch.

DETAILED DESCRIPTION OF THE INVENTION

Figure 1:
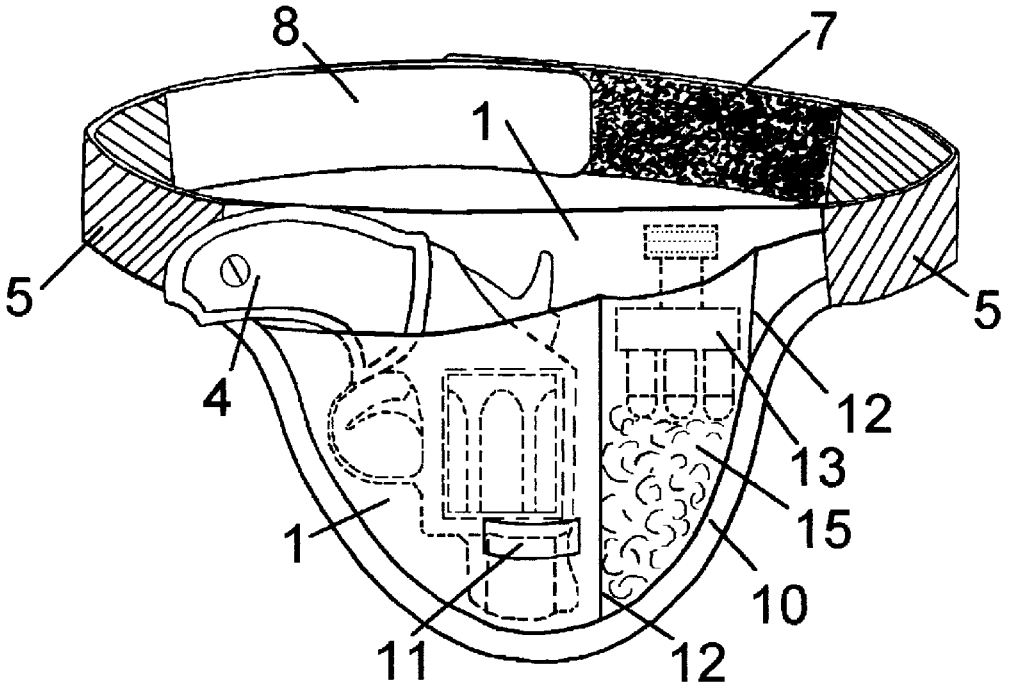
FIG. 1 is a perspective view of my invention showing a medium size right hand draw holster with a revolver in the firearm pocket and a speed-loader in the tactical reload pocket.
Figure 2:
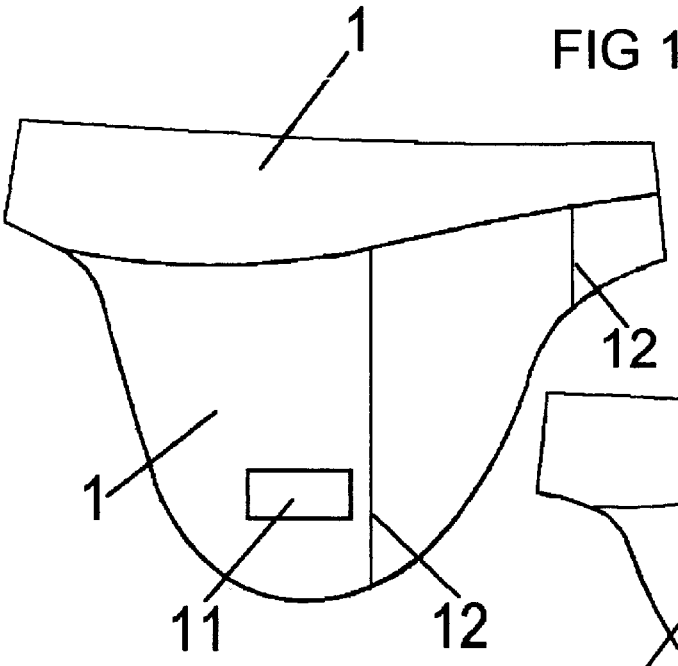
FIG. 2 is a front elevation view of a large, right hand draw holster without elastic or hook and loop strapping attached.
Figure 3:
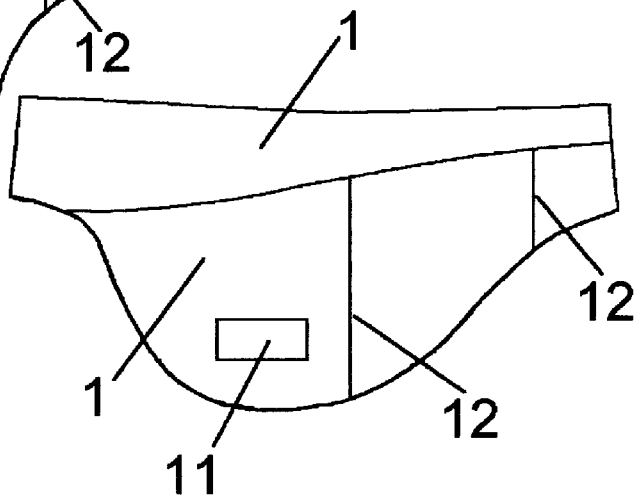
FIG. 3 is a front elevation view of a small, right hand draw holster without elastic or hook and loop strapping attached.
Figure 14:
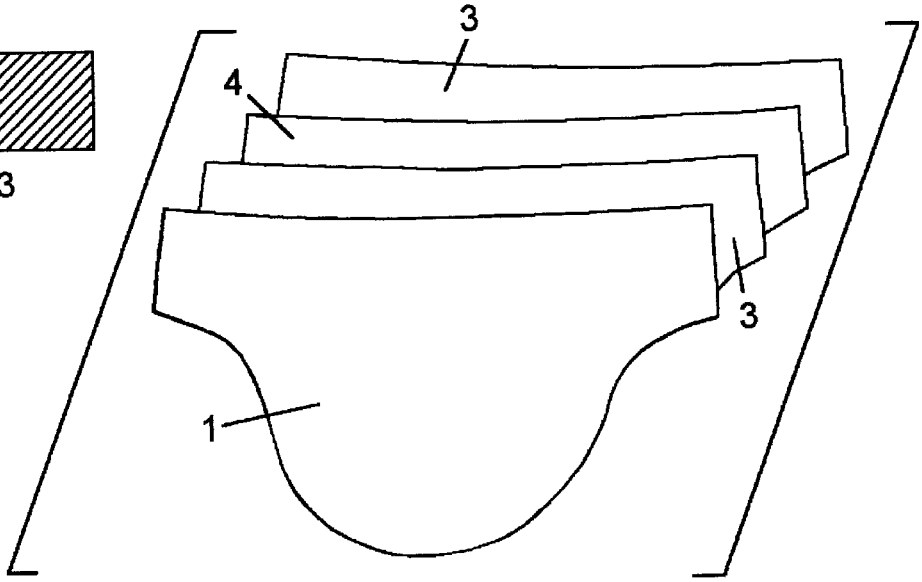
FIG. 14 is an exploded view of the rear assembly of a medium right hand draw holster.

Referring to FIG. 1 will show a revolver 14 holstered in a medium size right hand draw holster with a speed-loader 13 in the tactical back-up reload pocket. A filler material 15 is inserted in the back-up reload pocket to allow approximately ¼ inch to ½ inch of the speed-loader handle (or magazine, if a semi-automatic pistol is being carried) project above the pocket, allowing easy retrieval of the tactical reload. The seams 12 securing the holster front assembly FIG. 16 to the holster rear assembly FIG. 14 are shown in this and other figures. FIG. 2 shows the dimensions for a large size right hand draw holster and FIG. 3 shows the dimensions for a small size right hand draw holster. To produce a left hand draw holster, these patterns are mirrored.

Figure 4:
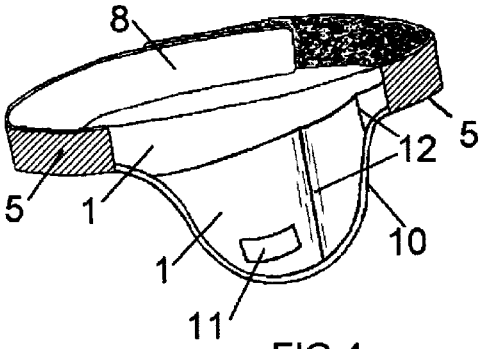
FIG. 4 is a perspective view of a medium size right hand draw holster.
Figure 5:
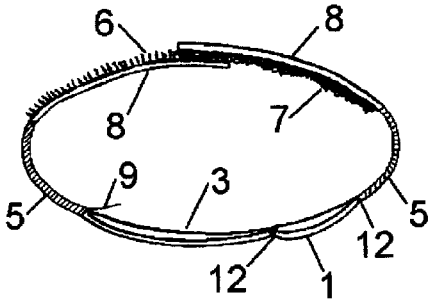
FIG. 5 is a top plan view of a medium size right hand draw holster.
Figure 7:
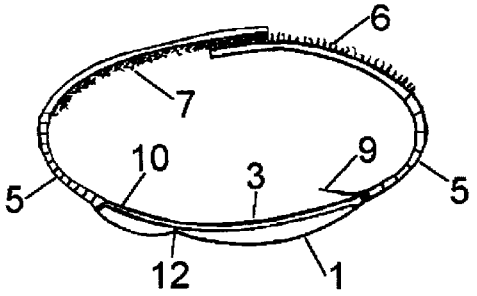
FIG. 7 is a bottom plan view of a medium size right hand draw holster.
Figure 9:
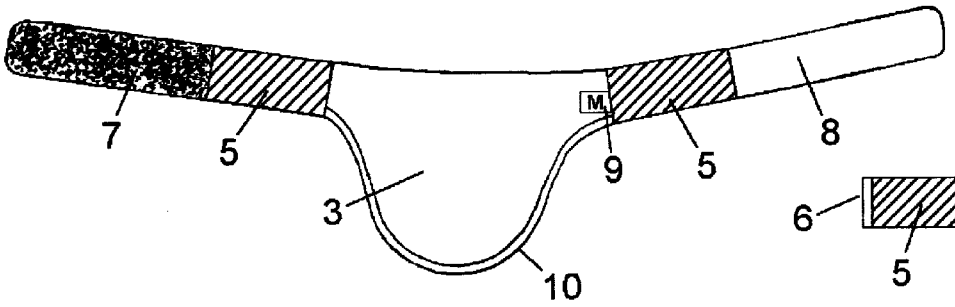
FIG. 9 is a rear elevation view of a medium size right hand draw holster.
Figure 16:
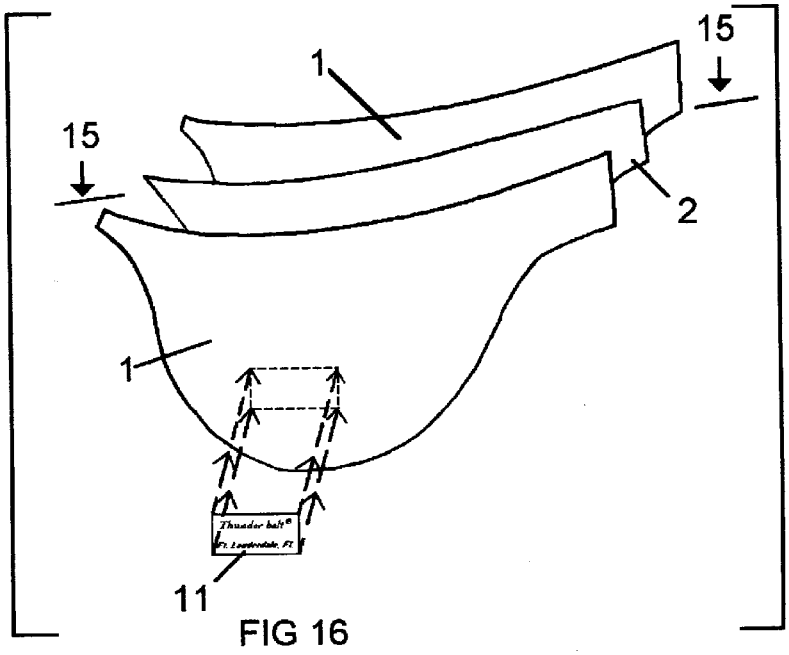
FIG. 16 is an exploded view of the forward assembly of a medium right hand draw holster.

FIG. 4 is a perspective view of a medium size right hand draw holster and shows the location of denim I used in construction of the outer front surface of the rear assembly FIG. 14 and the innermost and outermost I surfaces of the front assembly FIG. 16. The location of the identification label 11, if desired, is shown. Top plan view FIG. 5 shows the location of the holster size label 9 on the rear of the holster where the denim I is crosshatched stitched, several times, to the twill elastic 5 on the left side of the holster. The size label 9 is located on the rear of the holster to prevent any possible snagging on the sights or other protrusions on the firearm. The size label 9 location is also shown on the bottom plan view FIG. 7 and the rear elevation view FIG. 9.

Figure 6:
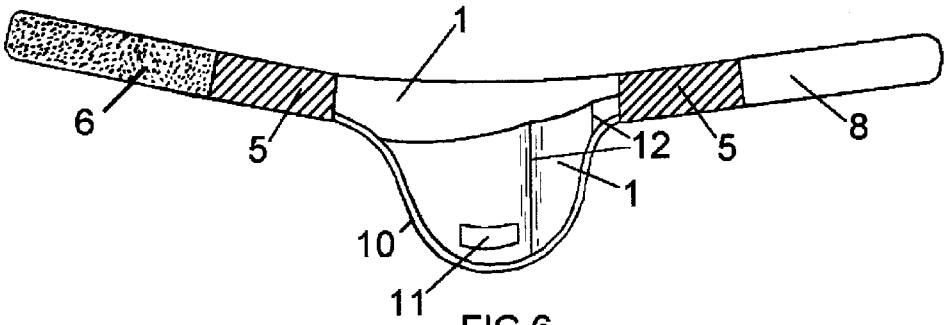
FIG. 6 is a front elevation view of a medium size right hand draw holster.

FIG. 6 is a front elevation view of a medium right hand draw holster showing the location where the twill elastic 5 attaches to the holster rear assembly FIG. 14 and where the hook 6 standard length strapping attaches to the twill elastic 5. The twill elastic 5 is folded back and double sewn with a crosshatch stitch to the hook strapping 6 on the left side of the holster and the loop strapping 7 on the right side of the holster. Both hook 6 and loop 7 strapping have black belting material 8 sewn to their rear, or non-gripping sides. One half inch double folded bias tape 10 is sewn around the sides and bottom of the assembled holster.

Figure 8:
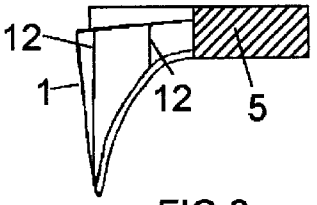
FIG. 8 is a right side elevation view of a medium size right hand draw holster.
Figure 10:
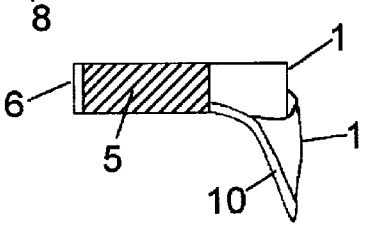
FIG. 10 is left side elevation view of a medium size right hand draw holster.
Figure 11:
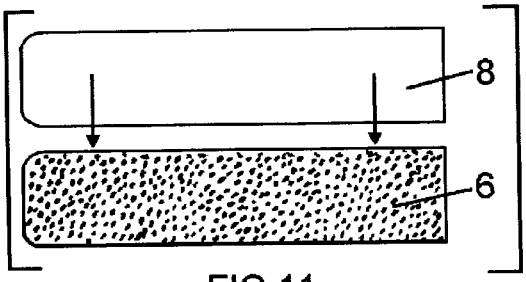
FIG. 11 is a front elevation view of left side standard length hook and loop strapping.
Figure 12:
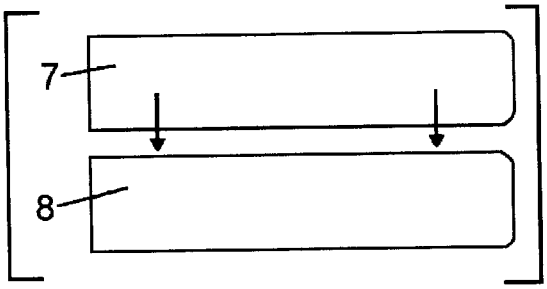
FIG. 12 is a front elevation view of right side standard length hook and loop strapping.
Figure 13:
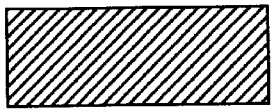
FIG. 13 is a front elevation of both left and right side elastic webbing.

FIG. 11 shows an exploded view of the standard length strapping hook 6 with black bell backing 8 sewn to the rear or non-hook side which attaches to the left side of the rear assembly FIG. 14. FIG. 12 shows the same assembly with the standard length loop 7 strapping sewn to the black belt backing 8. The arrows show the direction of belt backing 8 attachment to the hook 6 and loop 7. Standard length strapping, eight and three quarters inches long when assembled, each side, will accommodate a user hip circumference of up to 45 inches. A portion of the bell backing 8 can be seen in FIG. 8, the right side elevation view and a portion of the hook strapping 6 can be see in FIG. 10, the left side elevation view. The length of the hook 6 and loop 7 can be extended to 10¾ inches for users with hip circumferences up to 52 inches, and longer for larger users. FIG. 13 shows the length of the twill elastic 5 that is used on all size and strapping length holsters.

FIG. 14 is an exploded view which shows the construction of the holster rear assembly, with the denim 1 front piece sewn to a piece of cotton muslin 3 which is sandwiched with a piece of cotton flannel 4 and another layer of cotton muslin 3. This material provides a moisture barrier to protect the firearm from body perspiration. A ¼ inch seam allowance has been included on the denim I front piece to allow a french seam with the rear cotton muslin 3 piece. The ends of the cotton muslin 3 and cotton flannel 4 are 2 inches wide to match with the twill elastic 5.

Figure 15:
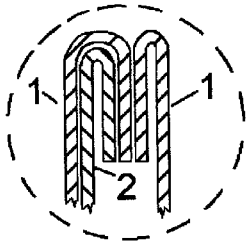
FIG. 15 is a sectional view of the french seam stitching used at section 15 in FIG. 16.

FIG. 16 is an exploded view which shows the construction of the holster front piece. The denim 1 front panel and rear panel 1 have a piece of cotton quilted batting 2 sandwiched between them and a seam allowance can be seen on the front 1 and rear 1 denim to allow a french seam as shown in the sectional view of the seam in FIG. 15. This view is taken from the side of the holster at view 15 in FIG. 16. The french seam on the front top edge of the front assembly eliminates any downward facing seams which can snag on the rear of cylinders of revolvers or protrusions on some semi-automatic pistols. When the holster front FIG. 16 and rear FIG. 14 assemblies are sewn together along the sides and lower border, a strip of ½ inch double folded bias tape 10 is added.

I claim:

1. A handgun holster for concealment under user clothing, comprising:

a forward panel having a forward panel upper edge, two opposing forward panel side edges and a forward panel lower edge, said forward panel comprising a forward sheet of flexible material having a forward sheet lower edge, two forward sheet side edges, and a forward sheet upper edge, and a rearward sheet of flexible material having a rearward sheet lower edge sewn to said forward sheet lower edge, two rearward sheet side edges sewn to adjacent said forward sheet side edges and thereby forming two composite sheet side edges, and a rearward sheet upper edge, said rearward sheet upper edge being folded over itself toward said forward sheet and forming a rearward cuff, and said forward sheet upper edge being folded over itself toward said rearward sheet and forming a forward cuff, said rearward cuff and said forward cuff being interconnected by a stitched cuff interconnection seam, such that said forward and rearward sheet cuffs are sealed from contact with a gun;

a rearward panel having a rearward panel upper edge, two opposing rearward panel side edges joined to corresponding said forward panel side edges and a rearward panel lower edge joined to said forward panel lower edge, said forward panel and said rearward panel together defining a gun receiving pocket having two opposing pocket side edges and said forward panel upper edge and said rearward panel upper edge defining a gun passing opening;

strap means extending from said forward and rearward panels rearwardly and defining a loop for encircling and thereby engaging a user's waist, and wherein said strap means comprises a user waist strap connected to and extending from one said pocket side edge to the other said pocket side edge.

2. A handgun holster as in claim 1, wherein said forward sheet has an interior face, additionally comprising a piece of batting extending across said forward sheet interior face and extending into said forward cuff, said stitched cuff interconnection seam passing through said batting and thereby forming a french seam at the forward panel upper edge.

3. A handgun holster as in claim 1, wherein said front panel comprises denim.

4. A handgun holster as in claim 1, wherein said strap means comprises two separate strap segments, one said strap segment extending substantially rearwardly from each said pocket side edge, and means for releasibly connecting said strap segments to form a waist engaging loop around a user waist.

5. A handgun holster as in claim 4, wherein said strap means is elastic.

6. A handgun holster for concealment under a user's clothing, comprising:

a rearward panel having a rearward panel upper edge, two opposing rearward panel side edges and a rearward panel lower edge, said rearward panel comprising a rearward sheet of flexible material having a rearward sheet lower edge, two rearward sheet side edges, and a rearward sheet upper edge, and a forward sheet of flexible material having a forward sheet lower edge sewn to said rearward sheet lower edge, two forward sheet side edges sewn to adjacent said rearward sheet side edges and thereby forming two composite sheet side edges, and a forward sheet upper edge, said forward sheet upper edge being folded over itself toward said rearward sheet and forming a forward cuff, and said rearward sheet upper edge being folded over itself toward said forward sheet and forming a rearward cuff, said forward cuff and said rearward cuff being interconnected by a stitched cuff interconnection seam, such that said rearward and forward sheet cuffs are sealed from contact with a gun;

a forward panel having a forward panel upper edge, two opposing forward panel side edges joined to corresponding said rearward panel side edges and a forward panel lower edge joined to said rearward panel lower edge, said rearward panel and said forward panel together defining a gun receiving pocket having two opposing pocket side edges and said rearward panel upper edge and said forward panel upper edge defining a gun passing opening;

strap means extending from said rearward and forward panels forwardly and defining a loop for encircling and thereby engaging a user's waist, and wherein said strap means comprises a user waist strap connected to and extending from one said pocket side edge to the other said pocket side edge.

7. A handgun holster as in claim 6, wherein said rearward sheet has an interior face, additionally comprising a piece of batting extending across said rearward sheet interior face and extending into said rearward cuff, said stitched cuff interconnection seam passing through said batting and thereby forming a french seam at the rearward panel upper edge.

8. A handgun holster as in claim 6, wherein said front panel comprises denim.

9. A handgun holster as in claim 6, wherein said strap means comprises two separate strap segments, one said strap segment extending substantially rearwardly from each said pocket side edge, and means for releasibly connecting said strap segments to form a waist engaging loop around a user waist.

10. A handgun holster as in claim 9, wherein said strap means is elastic.

11. A handgun holster for concealment under a user's clothing, comprising:

a forward panel having a forward panel upper edge, two opposing forward panel side edges and a forward panel lower edge, said forward panel comprising a forward sheet of flexible material having a forward sheet lower edge, two forward sheet side edges, and a forward sheet upper edge, and a rearward sheet of flexible material having a rearward sheet lower edge sewn to said forward sheet lower edge, two rearward sheet side edges sewn to adjacent said forward sheet side edges and thereby forming two composite sheet side edges, and a rearward sheet upper edge, said rearward sheet upper edge being folded over itself toward said forward sheet and forming a rearward cuff, and said forward sheet upper edge being folded over itself toward said rearward sheet and forming a forward cuff, said rearward cuff and said forward cuff being interconnected by a forward stitched cuff interconnection seam, such that said forward and rearward sheet cuffs are sealed from contact with a gun;

a rearward panel having a rearward panel upper edge, two opposing rearward panel side edges joined to corresponding said forward panel side edges and a rearward panel lower edge joined to said forward panel lower edge, a rearward panel having a rearward panel upper edge, two opposing rearward panel side edges and a rearward panel lower edge, said rearward panel comprising a rearward sheet of flexible material having a rearward sheet lower edge, two rearward sheet side edges, and a rearward sheet upper edge, and a forward sheet of flexible material having a forward sheet lower edge sewn to said rearward sheet lower edge, two forward sheet side edges sewn to adjacent said rearward sheet side edges and thereby forming two composite sheet side edges, and a forward sheet upper edge, said forward sheet upper edge being folded over itself toward said rearward sheet and forming a forward cuff, and said rearward sheet upper edge being folded over itself toward said forward sheet and forming a rearward cuff, said forward cuff and said rearward cuff being interconnected by a rearward stitched cuff interconnection seam, such that said rearward and forward sheet cuffs are sealed from contact with a gun;

said forward panel and said rearward panel together defining a gun receiving pocket having two opposing pocket side edges and said forward panel upper edge and said rearward panel upper edge defining a gun passing opening;

and strap means extending from said forward and rearward panels rearwardly and defining a loop for encircling and thereby engaging a user waist.

* * * * *